US009637869B1

(12) United States Patent
Hutcheson

(10) Patent No.: US 9,637,869 B1
(45) Date of Patent: May 2, 2017

(54) METHOD FOR FACILITATING DETECTING AND TRACKING MOVEMENT ACROSS AN AREA

(71) Applicant: Ronald A. Hutcheson, Melbourne Beach, FL (US)

(72) Inventor: Ronald A. Hutcheson, Melbourne Beach, FL (US)

( * ) Notice: Subject to any disclaimer, the term of this patent is extended or adjusted under 35 U.S.C. 154(b) by 627 days.

(21) Appl. No.: 13/901,322

(22) Filed: May 23, 2013

Related U.S. Application Data

(60) Provisional application No. 61/689,192, filed on Jun. 1, 2012.

(51) Int. Cl.
*G01N 21/91* (2006.01)
*E01C 11/00* (2006.01)

(52) U.S. Cl.
CPC ..... *E01C 11/00* (2013.01)

(58) Field of Classification Search
CPC ..... G01N 21/91
USPC ..... 250/302
See application file for complete search history.

(56) References Cited

U.S. PATENT DOCUMENTS

| | | | | |
|---|---|---|---|---|
| 3,812,052 | A | 5/1974 | Weston | |
| 4,089,797 | A | 5/1978 | Heller et al. | |
| 4,324,682 | A | 4/1982 | Weston et al. | |
| 4,481,422 | A | 11/1984 | deMarco et al. | |
| 4,968,024 | A * | 11/1990 | Hawkins | 472/86 |
| 5,734,167 | A | 3/1998 | Skelly | |
| 6,524,390 | B1 | 2/2003 | Jones | |
| 7,279,234 | B2 | 10/2007 | Dean | |
| 8,813,627 | B2 * | 8/2014 | Velasco | 89/1.11 |
| 2006/0214141 | A1 | 9/2006 | Yankielun et al. | |
| 2009/0068116 | A1 | 3/2009 | Arndt | |
| 2010/0288943 | A1 * | 11/2010 | Lambert | 250/459.1 |
| 2014/0150708 | A1 * | 6/2014 | Riekie | 116/201 |
| 2014/0369749 | A1 * | 12/2014 | Friedman et al. | 404/72 |

FOREIGN PATENT DOCUMENTS

| | | |
|---|---|---|
| CN | 101024593 | 8/2007 |
| JP | 2008019575 | 1/2008 |
| WO | WO 2008138044 | 11/2008 |

OTHER PUBLICATIONS http://www.umccorp.com/luminova.htm; Homepage, Webpage downloaded Mar. 23, 2015.*
Luminova website (http://www.umccorp.com/luminova.htm; Homepage).*

* cited by examiner

*Primary Examiner* — David Porta
*Assistant Examiner* — Hugh H Maupin
(74) *Attorney, Agent, or Firm* — William E. Beaumont; Juneau & Mitchell

(57) ABSTRACT

A method of facilitating monitoring and interdicting of targets crossing through an area comprising first mixing a luminescent pigment and a soil stabilizer, second loading the mixture into a spray dispenser, third dispensing the mixture in a substantially continuous coating covering a swathe of ground, and fourth monitoring said continuous coating covering said swathe of ground for disturbances in the continuity of said swathe.

38 Claims, 1 Drawing Sheet

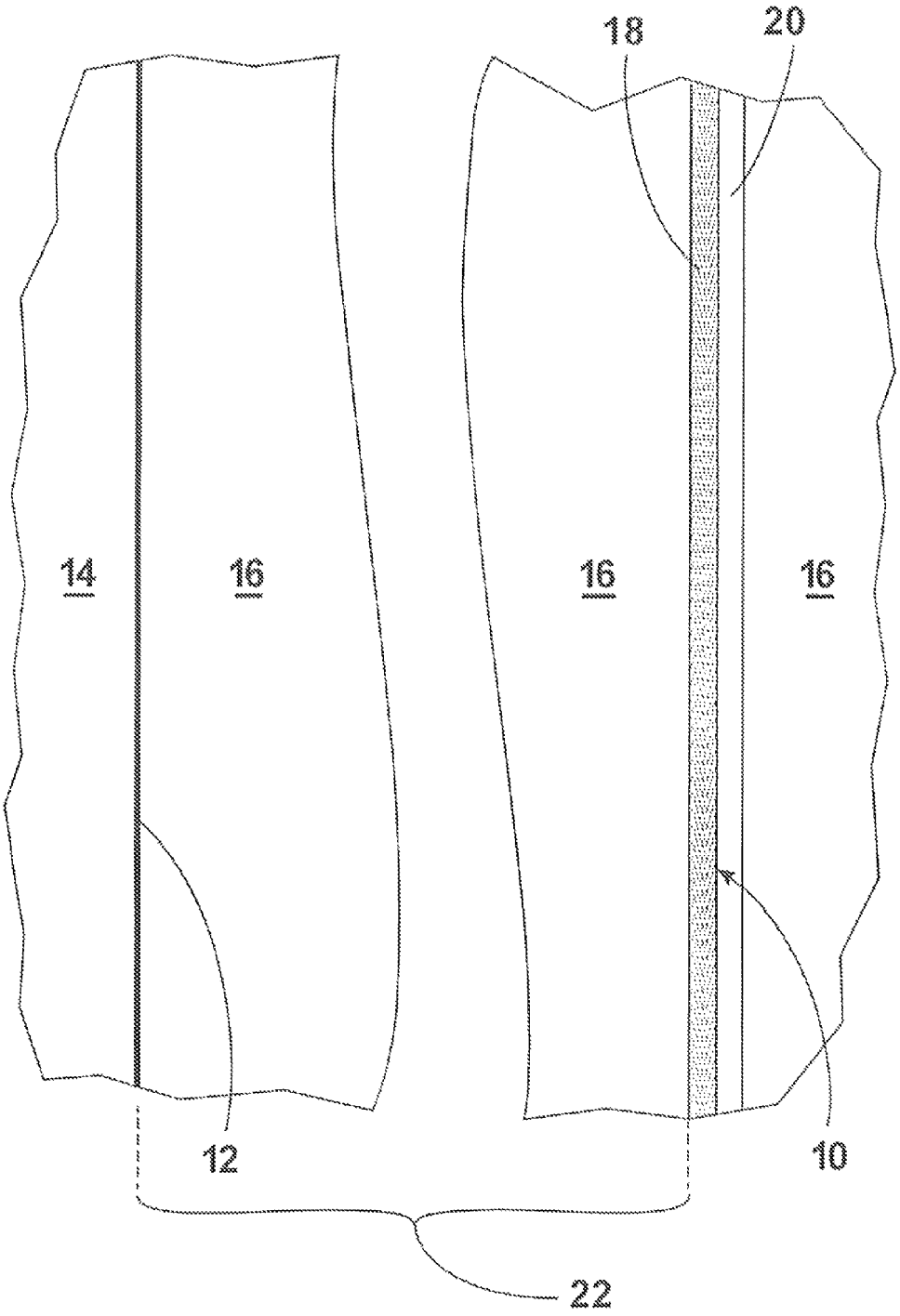
18
20
14
16
16
16
12
10
22

METHOD FOR FACILITATING DETECTING AND TRACKING MOVEMENT ACROSS AN AREA

CROSS REFERENCE TO RELATED APPLICATIONS

The instant application contains subject matter disclosed in applicant's provisional patent application No. 61/689,192 filed on Jun. 01, 2012, and accordingly it is respectfully requested that this application be accorded the above priority date of Jun. 01, 2012 for any common matter. According applicant hereby claim any benefits under 35 U.S.C. 119(e) of the above indicated United States provisional application.

BACKGROUND OF THE INVENTION

Field of the Invention

The present invention relates to a border detection method, and more particularly, a METHOD FOR FACILITATING DETECTING AND TRACKING MOVEMENT ACROSS AN AREA.

Description of the Prior Art

Numerous innovations for detecting movement across specified areas have been provided in the prior art that will be described. Even though these innovations may be suitable for the specific individual purposes to which the address, however, they differ from the present invention.

A FIRST EXAMPLE, U.S. Patent Office Document No. 20060214141, Published/Issued on Sept. 28, 2006, to Yankielun, et al. teaches a method, and a compound for facilitating it, that enhances night vision by dispersing a luminescent to provide low-intensity area illumination. Luminescents may include naturally occurring bioluminescents (visible spectrum) or man-made, preferably non-toxic, chemical-based luminescents (also termed chemiluminescents), the latter available for use in either the visible or IR spectrum. It may be applied locally to a surface or remotely by means of a delivery system. Preferably, select luminescents are dispersed as an aerosol to contact targeted surfaces. These luminescents may be used in spaces otherwise difficult to image with night vision equipment. Specifically provided is a method for viewing a target under low ambient light conditions comprising dispersing a luminescent material on surfaces in a dark space to provide a low-level, spatially broad, source of supplemental scene illumination, and viewing the target with image enhancing devices that are otherwise marginally useful without the presence of the luminescent material.

A SECOND EXAMPLE, U.S. Patent Office Document No. 20100288943, Published/Issued on Nov. 18, 2010, to Lambert teaches a low-cost, easily deployed, degradable taggant that can be dispersed over a wide area to serve as a witness to activity in the area and for queuing of other sensors. The taggant enables nearly real-time change detection within the treated area using one or more simple optical sensing techniques.

A THIRD EXAMPLE, U.S. Patent Office Document No. 4481422, Published/Issued on Nov. 06, 1984, to deMarco, et. al. teaches a camouflage luminescent composition comprising by weight: 52 to 54% of a osphor, 1 to 3% of a pyrogenic colloidal silica; 0 to 3% of a raw umber colorant; 8 to 15% of an organic resin binder; 23 to 46% of a aromatic hydrocarbon solvent, and a method of use thereof.

A FOURTH EXAMPLE, U.S. Patent Office Document No. 4324682, Published/Issued on Apr. 13, 1982, to Weston, et al. teaches a composition of matter useful for marking and identification purposes comprising a continuous, pressure rupturable coating containing (1) a flourescent material and (2) a water-insoluble, volatile, hydrocarbon solvent and a method of marking and identifying objects therewith.

A FIFTH EXAMPLE, U.S. Patent Office Document No. 6524390, Published/Issued on Feb. 25, 2003, to Jones teaches a handwashing medium which may be in liquid, cream, powder or spray form is provided with a detection agent such as an invisible fluorescent additive, which combination is then rubbed onto one'S hands using the individual's handwashing technique and is allowed to dry. The individual's hands are rinsed with water as in the normal handwashing fashion and the hands are then exposed to an activating agent such as an ultraviolet (UV) light source. Areas missed during handwashing retain the fluorescent additive and are clearly visible due to fluorescence. The method is useful in evaluating one's handwashing technique and has applicability anywhere cleanliness is required such as in hospitals, clinics, restaurants, etc., and may be used as an instructional aid in teaching young children proper hygiene techniques. The invisible fluorescent additive in a handwashing medium may also be used in determining patterns of body part contact such as contact with one's hands or feet in a given area by applying the invisible fluorescent additive to a body part and exposing the area to UV light to detect the presence of residue of the fluorescent agent.

A SIXTH EXAMPLE, U.S. Patent Office Document No. 7279234, Published/Issued on Oct. 09, 2007, to Dean teaches methods of using a transparent, luminescent polymer for transparent marking and/or labeling for identity verification purposes. Also disclosed are sheets, films, markers, labels and taggants comprising transparent, luminescent polymers. Also disclosed are articles labeled with a transparent, luminescent polymer. This invention particularly relates to use of transparent, luminescent polymer compositions comprising ethylene (meth)acrylic acid copolymers and rare earth ions and transparent, luminescent polymer compositions comprising methyl (meth)acrylate/(meth) acrylic acid copolymers, fatty acids and rare earth ions for these purposes.

A SEVENTH EXAMPLE, U.S. Patent Office Document No. 20090068116, Published/Issued on Mar. 12, 2009, to Douglas teaches a luminescent composition, with a luminescent marker and a ionizing agent exhibiting luminescence for an indicatory period once intermixed, and with luminance intensity remaining at a threshold intensity during indicatory period. Luminescence also can be exhibited responsive to responsive to excitatory light applied to the composition. The luminescent marker includes a coumarinic compound and the ionizing agent includes an ammonium base. Antimicrobial agents are included. A luminescence measuring apparatus includes a photoemitter and a photodetector responsive to an emissive light induced by photoemitter. An optical filter can be used with the photodetector. A two-phase composition dispensing apparatus includes a first phase reservoir, a second phase reservoir, a mixing nozzle, and a dispensing mechanism.

AN EIGHTH EXAMPLE, U.S. Patent Office Document No. 3812052, Published/Issued on May 21, 1947, to Weston teaches compositions of matter useful for marking and identification purposes comprising a solvent, a fluorescent material and a coumarone-indene resin and a method of marking and identifying objects therewith.

A NINTH EXAMPLE, U.S. Patent Office Document No. 4089797, Published/Issued on May 16, 1978, to Heller, et al. teaches an air-reactive chemiluminescent formulation is encapsulated and material which will catalyze the reaction of the formulation with air is affixed to the outside of the capsule. When the capsule is crushed, the formulation, air and the catalyst all come into contact with one other and high intensity light is produced rapidly.

A TENTH EXAMPLE, U.S. Patent Office Document No. 5734167, Published/Issued on Mar. 31, 1998, to Skelly teaches methods of farming, which are particularly useful at nighttime, include a method of using apparatus to enable an equipment operator to determine and maintain a course along a field. The methods enable a user to determine spray patterns in target areas that have been sprayed with agricultural products. The methods employ fluorescent pigments and a source of illumination which causes the fluorescent pigments to fluoresce.

AN ELEVENTH EXAMPLE, Japanese Patent Office Document No. JP 2008019575, Published/Issued on Jan. 31, 2008, to Maruyama, et al. teaches to solve the following problems that: much labor and a long time are required because an existing rigid layer must be stripped off when a paving board for guidance is applied to an existing pavement, though the paving board for guidance containing a luminous agent is also used, because refuge becomes impossible and there is a high risk that a secondary disaster may occur due to the impossibility of the refuge on the ground that its gets completely pitch-dark, in the case that a power failure occurs in a subway due to earthquakes; a resin cannot be preserved for a long period of time because the resin is inevitably scraped away by persons' feet and other moving objects, in the case of a method in which the resin containing a luminous pigment is applied to the pavement; and the resin should be preserved for a long period of time, particularly, so as to prepare countermeasures against a natural disaster occurring once in several years or once in several decades. ; SOLUTION: A groove section is provided by grinding the existing rigid pavement, and the luminous pigment and the resin are applied into the groove section. The luminous pigment and the resin are applied as a mixture. Otherwise, firstly, the resin is applied, the luminous pigment is sprayed on the resin, and the sprayed luminous pigment is topcoated.

A TWELFTH EXAMPLE, Chinese Patent Office Document No. CN 101024593, Published/Issued on Aug. 29, 2007, to Sun Yuke teaches a manufacture method for flower fertilizer that has decoration effect. It is made up from 10-20 portions of celadon calcium magnesium phosphorus, 14-23 portions of white ammonia sulfate, 10-20 portions of red potassium chloride, 1-5 portions of white borax, 2-8 portions of white zinc sulphate, 15-25 portions of urea formaldehyde, 5-15 portions of grey ammonium phosphate, 5-10 portions of yellow alta mud, 2-8 portions gold powder, and 2-5 portions of luminous paint. The invention could be used on the surface of soil and could improve sensitive of beauty.

A THIRTEENTH EXAMPLE, World Intellectual Property Office Document No. WO 2008138044, Published/Issued on Nov. 20, 2008, to Osvath, et al. teaches a tagged explosive comprising an explosive composition and a precursor tag, the precursor tag comprising a transformable material that can transform during detonation of the explosive composition into a luminescent tag.

It is apparent now that numerous innovations for detection methods have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a METHOD FOR FACILITATING DETECTING AND TRACKING MOVEMENT ACROSS AN AREA that avoids the disadvantages of the prior art.

ANOTHER OBJECT of the present invention is to provide a METHOD FOR FACILITATING DETECTING AND TRACKING MOVEMENT ACROSS AN AREA that is simple and inexpensive to implement.

STILL ANOTHER OBJECT of the present invention is to provide a METHOD FOR FACILITATING DETECTING AND TRACKING MOVEMENT ACROSS AN AREA that is simple to use.

BRIEFLY STATED, STILL YET ANOTHER OBJECT of the present invention is to provide a METHOD AND FOR FACILITATING DETECTING AND TRACKING MOVEMENT ACROSS AN AREA that is easily noticed by the persons, animals or vehicles being tracked.

The novel features which are considered characteristic of the present invention are set forth in the appended claims. The invention itself, however, both as to its construction and its method of operation, together with additional objects and advantages thereof, will be best understood from the following description of the specific embodiments when read in conjunction with the drawing.

BRIEF DESCRIPTION OF THE DRAWING

The FIGURE of the drawing is briefly described as follows:

The FIGURE is a diagram illustrating the relative orientation of the road of the present invention with respect to a border between a source area and a target area.

A MARSHALING OF REFERENCE NUMERALS UTILIZED IN THE DRAWING

10 Road
12 Border
14 Source Area
16 Target Area
18 Tracking Area
20 Monitoring Area
22 Distance from a point on the border 12 to the nearest point on the road 10

DETAILED DESCRIPTION OF THE PREFERRED EMBODIMENT

Referring now to the drawings, FIG. 1 shows a general schematic to relate the orientation of a road 10 to a border 12 between a source area 14 and a target area 16, showing that there exists a gap between the border 12 and the road 10, and that the road 10 is placed in the target area 16. The road 10 is further subdivided into a tracking area 18 and a monitoring area 20.

Referring now to the method of the invention, the method comprises 9 principal steps, some of which have sub-steps, which when completed will greatly facilitate detection and interdiction of targets crossing an area. In particular, the invention is well suited to aiding in enforcement of national borders, particularly borders in substantially desert areas, such as exist for much of the border between the United States and Mexico.

The Steps in the Method of the Invention are:

1.) Establishing a swathe of ground, wherein the swathe of ground is established with respect to a source area 14 and a target area 16 and wherein the swathe of ground lies within the target area 16. Specifically, the source area 14 is the area from which subjects to be tracked emanate from, and the target area 16 is the area to which they seek to go. The border 12 between the source area 14 and the target area 16 in a preferred use is a national border 12.

2.) Preparing the swathe of ground by forming thereon a bed of sand. The bed of sand is preferably at least 2 inches in deep, and at most 4 inches deep. This depth will allow for stable and durable road 10 without requiring excessively costly construction.

3.) Combining into a mixture water and a soil stabilizer. In a preferred use, the soil stabilizer is a liquid polymer based emulsion soil stabilizer as sold under the trademark TOPSEAL™ by Soils Control International of PO Box 200117, Austin Tex. 78720 U.S.A. The mixture is in a preferred use at least 4 parts water to one part soil stabilizer by volume, and at most 9 parts water to one part soil stabilizer by volume. The dilution of the stabilizer in water prevents the formation of an extremely hard or slick surface, on which footprints and other evidence would not collect easily, and where the presence of the luminescent pigment of the present invention would be more obvious to a subject.

4.) Loading the mixture of water and soil stabilizer into a dispensing means, preferably a sprayer.

5.) Dispensing the mixture of water and soil stabilizer onto the bed of sand for said mixture to seep into said bed of sand. In a preferred use, at least ¼ gallon of mixture is used per 100 square feet of the sand bed, and at most 1 gallon of mixture is used per 100 square feet of the sand bed. The preferred rate one-half gallon per 100 square feet of sand bed, which produces a durable road 10 while still not producing such a rigid surface as to hinder evidence collection or the inconspicuousness of the luminescent material.

6.) Waiting for the water and soil stabilizer mixture which has seeped into said bed of sand to cure, which will produce a durable surface.

7.) Establishing a tracking area 18 and a monitoring area 20 within the swathe of ground, wherein the tracking area 18 has a surface end wherein the monitoring area 20 has a surface. The tracking area 18 runs along the entirety of the length of the swathe of ground. The monitoring area 20 also runs along the entirety of the length of the swathe of ground. The surface of the tracking area 18 in combination with the surface of the monitoring area 20 together constitute the whole surface of the swathe of ground.

8.) Spreading a luminescent pigment onto the surface of the tracking area 18 in a substantially continuous coating. The luminescent pigment is preferably a strontium oxide aluminate luminescent pigment as sold under the trademark LumiNova® by the United Mineral & Chemical Corp of 1050 Wall Street West, Suite 660 Lyndhurst, N.J. 07071 U.S.A. This is accomplished by spreading at least 2 pounds of strontium oxide aluminate luminescent pigment per 100 square feet of surface, and at most 4 pounds of strontium oxide aluminate luminescent pigment per 100 square feet of surface. Preferably, in order to avoid a subject noticing the pigment during daylight (when the pigment will not luminesce), the pigment should have a granule size similar to that of the sand of the sand bed, for example the granule size marketed as G-300L250N sold under the trademark LumiNova® by the United Mineral & Chemical Corp. The range of 2 to 4 pounds per 100 square foot allows for sufficient nighttime luminescence to deter crossing of the swathe of land, while still not making the luminescent pigment obvious to the naked eye of a subject in daylight.

9.) Monitoring said tracking area 18 for evidence subjects crossing said tracking area 18. The monitoring step comprises sub-steps as follows:

I Observing the tracking area 18 from the monitoring area 20.

II Noting any disturbances in said luminescent pigment on said surface of said tracking area 18.

III Documenting any disturbances in said luminescent pigment on said surface of said tracking area 18.

IV Restoring said luminescent pigment on said surface of said tracking area 18. The restoring sub-step comprises sub-sub-steps as follows:

i Raking said luminescent pigment.

ii Distributing additional luminescent pigment onto any portion of said surface of said tracking area 18 where a disturbance was noted.

Detailed Discussion of the Swathe of Ground

The swathe of ground is within the target area 16, and is within a reasonable proximity to the border 12 wherein the source area 14 abuts the target area 16, but not so close as to be easily visible from the border 12. Specifically the distance 22 from a point on the border 12 to the nearest point on the swathe of ground is at least 1 mile and at most 15 miles.

The swathe of ground has a length and a width. The width of the swathe of ground is at least 20 feet and at most 200 feet. The length of the swathe of ground is at least 500 feet and may extend to any practical length. The swathe in the preferred embodiment comprises a road 10, however only the monitoring area 20 of the swathe is intended to be used as a road 10, so as not to disturb the tracking area 18. Being a road 10, the practical length of the swathe may be very long, with the primary limitations being geographic (e.g. oceans).

The length of the swathe is substantially parallel to the border 12 between said source area 14 and the target area 16, and the width of the swathe is accordingly substantially perpendicular to the border 12 between the source area 14 and said target area 16. The swathe of ground has therefore two sides to its width, one of which is proximal to the border 12, and one of which is distal from the border 12. The tracking area 18 is disposed along the proximal side of the swathe of ground, and the monitoring area 20 is disposed along the distal side of the swathe of ground. Between the border 12 and the swathe of ground there exists a controlled area, and the present invention facilitates detection of subjects exiting that controlled area.

Description of the Path

Referring now to the path of the invention, the path comprises a road 10 created by the above method for use in monitoring and interdicting of subjects crossing through an area. Specifically, the road 10 comprises: a swathe of ground, a bed of sand, a tracking area 18, a monitoring area 20, 1*a* mixture of water and a soil stabilizer, and luminescent pigment.

The swathe of ground comprises the ground on which the road 10 is constructed. The bed of sand comprises the base for the road 10. The tracking area 18 comprises a portion of the road 10. The monitoring area 20 comprises that portion of the road 10 which is not comprised of said tracking area 18. The mixture of water and said soil stabilizer creates a durable surface for said path. And the tracking area 18 has a substantially continuous coating of said luminescent pigment on the durable surface thereof.

With respect to the swathe of ground, it has a length and a width, wherein the width of the swathe of ground is at least 20 feet and at most 200 feet, and wherein the length of the swathe of ground is at least 500 feet.

With respect to the bed of sand, it is preferably at least 2 inches deep and at most 4 inches deep.

With respect to the mixture of water and soil stabilizer, it is in a preferred use at least 4 parts water to one part soil stabilizer by volume, and at most 9 parts water to one part soil stabilizer by volume. The dilution of the stabilizer in water prevents the formation of an extremely hard or slick surface, on which footprints and other evidence would not collect easily, and where the presence of the luminescent pigment of the present invention would be more obvious to a subject.

With respect to the tracking area 18 and the monitoring area 20, they both run along the entire length of the road 10.

With respect to the luminescent pigment, it is preferably a strontium oxide aluminate luminescent pigment as sold under the trademark LumiNova® by the United Mineral & Chemical Corp. At least 2 pounds of the luminescent pigment are used per 100 square feet of the surface of the tracking area 18 to be covered, and at most 4 pounds of the luminescent pigment are used per 100 square feet of the surface of the tracking area 18 to be covered.

With respect to the soil stabilizer, it is preferably a liquid soil stabilizer, specifically a liquid polymer based emulsion soil stabilizer as sold under the trademark TOP-SEAL™ by Soils Control International of PO Box 200117, Austin, Tex. 78720 U.S.A., With respect to the amount of the mixture of water and soil stabilizer present in proportion to the sand bed, at least ¼ gallon of mixture is used per 100 square feet of the sand bed, and at most 1 gallon of mixture is used per 100 square feet of the sand bed. The preferred rate is one -half gallon per 100 square feet of sand bed, which produces a durable road 10 while still not producing such a rigid surface as to hinder evidence collection or the inconspicuousness of the luminescent material.

While the invention has been illustrated and described as embodiments of a METHOD FOR FACILITATING DETECTING AND TRACKING MOVEMENT ACROSS AN AREA, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method of facilitating monitoring and interdicting of subjects crossing through an area, which comprises:

a) establishing a swathe of ground, wherein said swathe of ground is established with respect to a source area and a target area and wherein said swathe of ground lies within said target area;

b) preparing said swathe of ground by forming thereon a bed of sand;

c) combining into a mixture water and a soil stabilizer, wherein said soil stabilizer comprises a liquid polymer-based emulsion;

d) loading said mixture into a dispensing means;

e) dispensing said mixture onto said bed of sand for said mixture to seep into said bed of sand;

f) waiting for said mixture which has seeped into said bed of sand to cure;

g) establishing a tracking area and a monitoring area within said swathe, wherein said tracking area has a surface and wherein said monitoring area has a surface; and h) spreading a luminescent pigment onto said surface of said tracking area in a substantially continuous coating;

wherein said luminescent pigment comprises a strontium oxide aluminate pigment;

wherein said strontium oxide aluminate luminescent pigment has a granule size; and wherein said granule size of said strontium oxide aluminate luminescent pigment is substantially equivalent to the granule size of the sand of said bed of sand.

2. The method of claim 1 wherein said source area and said target area abut one another along a border.

3. The method of claim 2 wherein said swathe of ground has a length and a width; and wherein said width of said swathe is at least 20 feet and at most 200 feet.

4. The method of claim 3 wherein said length of said swathe of ground is at least 500 feet.

5. The method of claim 4 wherein said bed of sand is at least 2 inches deep.

6. The method of claim 5 wherein said bed of sand is not more than 4 inches deep.

7. The method of claim 6 wherein said mixture of water and said soil stabilizer is at least 4 parts water to one part soil stabilizer by volume, and at most 9 parts water to one part soil stabilizer by volume.

8. The method of claim 7 wherein said length of said swathe is substantially parallel to said border between said source area and said target area; and wherein said width of said swathe is substantially perpendicular to said border between said source area and said target area.

9. The method of claim 8 wherein said tracking area runs along the entirety of said length of said swathe of ground.

10. The method of claim 9 wherein said monitoring area runs along the entirety of said length of said swathe of ground.

11. The method of claim 10 wherein said width of said swathe of ground has:

a) a proximal side; and b) a distal side;

wherein said proximal side is closer to said border than said distal side.

12. The method of claim 11 wherein said tracking area is disposed along said proximal side of said swathe of ground; and wherein said monitoring area is disposed along said distal side of said swathe of ground.

13. The method of claim 12 wherein said surface of said tracking area and said surface of said monitoring area constitute the whole surface of said swathe of ground.

14. The method of claim 13 further comprising the step of monitoring said tracking area for evidence of subjects crossing said tracking area.

15. The method of claim 14 wherein said step of monitoring said tracking area comprises the sub-steps of:

a) observing said tracking area from said monitoring area;

b) noting any disturbances in said luminescent pigment on said surface of said tracking area;

c) documenting any disturbances in said luminescent pigment on said surface of said tracking area; and d) restoring said luminescent pigment on said surface of said tracking area.

16. The method of claim 15 wherein said step of restoring said luminescent pigment on said surface of said tracking area comprises the sub-steps of:

a) raking said luminescent pigment; and b) distributing additional luminescent pigment onto any portion of said surface of said tracking area where a disturbance was noted.

17. The method of claim 1 wherein said step of spreading a strontium oxide aluminate luminescent pigment onto said surface of said tracking area in a substantially continuous coating is accomplished by spreading at least two pounds of strontium oxide aluminate luminescent pigment per 100 square feet of surface.

18. The method of claim 17 wherein said step of spreading a strontium oxide aluminate luminescent pigment onto said surface of said tracking area in a substantially continuous coating is accomplished by spreading at most 4 pounds of strontium oxide aluminate luminescent pigment per 100 square feet of surface.

19. The method of claim 18 wherein said swathe of ground further comprises a road.

20. The method of claim 1 wherein said dispensing means comprises a sprayer.

21. The method of claim 20 wherein said sprayer dispenses at least ¼ of 1 gallon of said water and soil stabilizer mixture per 100 square feet of said sand bed being dispensed onto.

22. The method of claim 21 wherein said sprayer dispenses at most 1 gallon of said water and soil stabilizer mixture per 100 square feet of said sand bed being dispensed onto.

23. The method of claim 22 wherein there is a controlled area between said border and said swathe of ground.

24. The method of claim 23 wherein the distance from a point on said border to the nearest point on said swathe of ground is at least one mile.

25. The method of claim 24 wherein the distance from a point on said border to the nearest point on said swathe of ground is at most 15 miles.

26. A path for use in monitoring and interdicting of subjects crossing through an area, which comprises:

a) a swathe of ground;

b) a bed of sand;

c) a tracking area;

d) a monitoring area;

e) a mixture of water and a soil stabilizer, wherein said soil stabilizer comprises a liquid polymer-based solution;

f) a luminescent pigment;

wherein said swathe of ground comprises the ground on which said path is constructed;

wherein said bed of sand comprises the base for said path;

wherein said tracking area comprises a portion of said path;

wherein said monitoring area comprises that portion of said path which is not comprised of said tracking area;

wherein said mixture of said water and said soil stabilizer forms a durable surface for said path;

wherein said tracking area has a substantially continuous coating of said luminescent pigment on said durable surface;

wherein said luminescent pigment comprises a strontium oxide aluminate luminescent pigment;

wherein said strontium oxide aluminate luminescent pigment has a granule size; and wherein said granule size of said strontium oxide aluminate luminescent pigment is substantially equivalent to the granule size of the sand of said bed of sand.

27. The path of claim 26 wherein said path comprises a road.

28. The path of claim 27 wherein said swathe of ground has a length and a width; and wherein said width of said swathe is at least 20 feet and at most 200 feet.

29. The path of claim 28 wherein said length of said swathe of ground is at least 500 feet.

30. The path of claim 29 wherein said bed of sand is at least 2 inches deep.

31. The path of claim 30 wherein said bed of sand is not more than 4 inches deep.

32. The path of claim 31 wherein said mixture of water and soil stabilizer is at least 4 parts water to one part soil stabilizer by volume, and at most 9 parts water to one part soil stabilizer by volume.

33. The path of claim 32 wherein said tracking area runs along the entirety of said length of said swathe of ground.

34. The path of claim 33 wherein said monitoring area runs along the entirety of said length of said swathe of ground.

35. The path of claim 26 wherein said substantially continuous coating of said luminescent pigment comprises at least 2 pounds of said strontium oxide aluminate luminescent pigment per 100 square feet of surface.

36. The path of claim 26 wherein said substantially continuous coating of said luminescent pigment comprises at most 4 pounds of said strontium oxide aluminate luminescent pigment per 100 square feet of surface.

37. The path of claim 26 wherein said durable surface of said road incorporates at least 1/4 gallon of said mixture of said liquid polymer-based emulsion soil stabilizer per 100 square feet.

38. The fead path of claim 37 wherein said durable surface of said road incorporates at most 1 gallon of said mixture of said liquid polymer-based emulsion soil stabilizer per 100 square feet.

* * * * *